US005487192A

United States Patent [19]

Hodges

[11] Patent Number: 5,487,192

[45] Date of Patent: Jan. 30, 1996

[54] APPARATUS FOR THE RAISING AND SELF-LOWERING OF A TOILET SEAT

[76] Inventor: Glenn D. Hodges, Rte. 1, Box 800, Blowing Rock, N.C. 28605

[21] Appl. No.: 344,214

[22] Filed: Nov. 23, 1994

[51] Int. Cl.[6] ..... A47K 13/10

[52] U.S. Cl. ..... 4/246.3

[58] Field of Search ..... 4/246.1–246.5

[56] References Cited

U.S. PATENT DOCUMENTS

| | | | |
|---|---|---|---|
| 1,276,472 | 8/1918 | Zeen | 4/246.4 |
| 1,792,811 | 2/1931 | Bustin | 4/246.4 |
| 1,999,070 | 4/1935 | Svedelius | 4/246.5 |
| 2,155,548 | 4/1939 | Hompesch | 4/246.3 |
| 3,345,650 | 10/1967 | Waters | 4/246.5 |
| 3,417,411 | 12/1968 | Greenwood | 4/246.3 |

FOREIGN PATENT DOCUMENTS

| | | | |
|---|---|---|---|
| 0324667 | 5/1936 | Italy | 4/246.5 |

*Primary Examiner*—Charles E. Phillips

[57] ABSTRACT

An apparatus for the raising and self-lowering of a toilet seat comprising a lever, the lever being disposed in an essentially vertical plane having a central aperture extending therethrough for the receipt of a bolt and an associated nut for constituting a pivot point, the lever having an outboard end with a pedal secured thereto for being depressed by the foot of a user, the lever having an inboard end with an aperture therethrough for receipt of a bolt with an associated nut for transferring motion from the pedal to a toilet seat to be lifted upon the depression of the pedal; and a support assembly for attachment to a support bolt of a toilet seat and for supporting the lever at its pivot point, the support assembly including an L-shaped bracket with a horizontal leg formed with an aperture for being received by and secured to the support bolt of a toilet and with the L-shaped bracket having an upstanding leg with an aperture, the support assembly also having a horizontal bracket with a pair of apertures at each end, the apertures at one end being coupled to the apertures of the L-shaped bracket, the support assembly also including a vertical bracket having an upper end with two apertures adapted to be received in the outboard apertures of the horizontal bracket and with a lower end positionable in contact with the toilet for maintaining a proper orientation of the support assembly.

3 Claims, 4 Drawing Sheets

APPARATUS FOR THE RAISING AND SELF-LOWERING OF A TOILET SEAT

BACKGROUND OF THE INVENTION

1. Field of the Invention

The present invention relates to an apparatus for the raising and self-lowering of a toilet seat and more particularly pertains to raising a toilet seat through the use of a foot pedal while allowing for its lowering upon removal of the foot from the pedal.

2. Description of the Prior Art

The use of devices for use in association with toilets and toilet seats of various designs and constructions is known in the prior art. More specifically, devices for use in association with toilets and toilet seats of various designs and constructions heretofore devised and utilized for the purpose of raising and lowering of toilet seats through various methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,584,724 a toilet seat lifting and lowering device.

U.S. Pat. No. 4,649,576 discloses a foot-activated toilet seat lifting device.

U.S. Pat. No. 4,975,988 discloses a foot-operated toilet seat lifting and lowering mechanism.

U.S. Pat. No. 5,103,506 discloses a toilet seat lifter.

U.S. Pat. No. 5,237,708 discloses a foot actuated toilet seat lifting, anti-slamming, and reseating device.

In this respect, the apparatus for the raising and self-lowering of a toilet seat according to the present invention substantially departs from the conventional concepts and designs of the prior art, and in doing so provides an apparatus primarily developed for the purpose of raising a toilet seat through the use of a foot pedal while allowing for its lowering upon removal of the foot from the pedal.

Therefore, it can be appreciated that there exists a continuing need for a new and improved apparatus for the raising and self-lowering of a toilet seat which can be used for raising a toilet seat through the use of a foot pedal while allowing for its lowering upon removal of the foot from the pedal. In this regard, the present invention substantially fulfills this need.

SUMMARY OF THE INVENTION

In view of the foregoing disadvantages inherent in the known types of devices for use in association with toilets and toilet seats of various designs and constructions now present in the prior art, the present invention provides an improved apparatus for the raising and self-lowering of a toilet seat. As such, the general purpose of the present invention, which will be described subsequently in greater detail, is to provide a new and improved apparatus for the raising and self-lowering of a toilet seat and method which has all the advantages of the prior art and none of the disadvantages.

To attain this, the present invention essentially comprises a new and improved apparatus for the raising and self-lowering of a toilet seat comprising, in combination, a lever, the lever being disposed in an essentially vertical plane having a central aperture extending therethrough for the receipt of a bolt and an associated nut for constituting a pivot point, the lever having an outboard end twisted ninety degrees with a pedal secured thereto for being depressed by the foot of a user, the lever having an inboard end with an aperture therethrough for receipt of a bolt with an associated nut for transferring motion from the pedal to a toilet seat to be lifted upon the depression of the pedal, the lever being formed with an angular offset portion between the central aperture and the inboard aperture with the regions of the pedal on opposite sides thereof being parallel but offset with respect to each other; a support assembly for attachment to a support bolt of a toilet seat and for supporting the lever at its pivot point, the support assembly including an L-shaped bracket with a horizontal leg formed with an aperture for being received by and secured to the support bolt of a toilet and with the L-shaped bracket having an upstanding leg with two apertures, the support assembly also having a horizontal bracket with apertures at the ends, the apertures at one end being coupled to the apertures of the L-shaped bracket, the support assembly also including a vertical bracket having an upper end with two apertures adapted to be received in the outboard apertures of the horizontal bracket and with a lower end positionable in contact with the toilet for maintaining a proper orientation of the support assembly; and an attachment assembly having an L-shaped bracket with an upper leg having two apertures adapted to be secured to the lower surface of a toilet seat adjacent to its outboard end on its under surface with the L-shaped bracket having a lower leg positioned outboardly of the toilet seat with one aperture therethrough adapted to receive a bolt and an associated nut, the attachment assembly also including a vertical leg having an upper end with one aperture extending therethrough adapted to be coupled to the one aperture of the L-shaped bracket, the vertical bracket having a plurality of vertically-aligned apertures therethrough with an associated bolt positionable through a preselected one of said apertures and the aperture at the inboard end of the lever for coupling therebetween.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus for the raising and self-lowering of a toilet seat which has all the advantages of the prior art devices for use in association with toilets and toilet seats of various designs and constructions and none of the disadvantages.

It is another object of the present invention to provide a new and improved apparatus for the raising and self-lowering of a toilet seat which may be easily and efficiently manufactured and marketed.

It is further object of the present invention to provide a new and improved apparatus for the raising and self-lowering of a toilet seat which is of durable and reliable construction.

An even further object of the present invention is to provide a new and improved apparatus for the raising and self-lowering of a toilet seat which is susceptible of a low cost of manufacture with regard to both materials and labor, and which accordingly is then susceptible of low prices of sale to the consuming public, thereby making such apparatus for the raising and self-lowering of a toilet seat economically available to the buying public.

Still yet another object of the present invention is to provide a new and improved apparatus for the raising and self-lowering of a toilet seat which provides in the apparatuses and methods of the prior art some of the advantages thereof, while simultaneously overcoming some of the disadvantages normally associated therewith.

Still another object of the present invention is to raise a toilet seat through the use of a foot pedal while allowing for its lowering upon removal of the foot from the pedal.

Lastly, it is an object of the present invention to provide a new and improved apparatus for the raising and self-lowering of a toilet seat comprising a lever, the lever being disposed in an essentially vertical plane having a central aperture extending therethrough for the receipt of a bolt and an associated nut for constituting a pivot point, the lever having an outboard end with a pedal secured thereto for being depressed by the foot of a user, the lever having an inboard end with an aperture therethrough for receipt of a bolt with an associated nut for transferring motion from the pedal to a toilet seat to be lifted upon the depression of the pedal; and a support assembly for attachment to a support bolt of a toilet seat and for supporting the lever at its pivot point, the support assembly including an L-shaped bracket with a horizontal leg formed with an aperture for being received by and secured to the support bolt of a toilet and with the L-shaped bracket having an upstanding leg with an aperture, the support assembly also having a horizontal bracket with a pair of apertures at each end, the apertures at one end being coupled to the apertures of the L-shaped bracket, the support assembly also including a vertical bracket having an upper end with two apertures adapted to be received in the outboard apertures of the horizontal bracket and with a lower end positionable in contact with the toilet for maintaining a proper orientation of the support assembly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
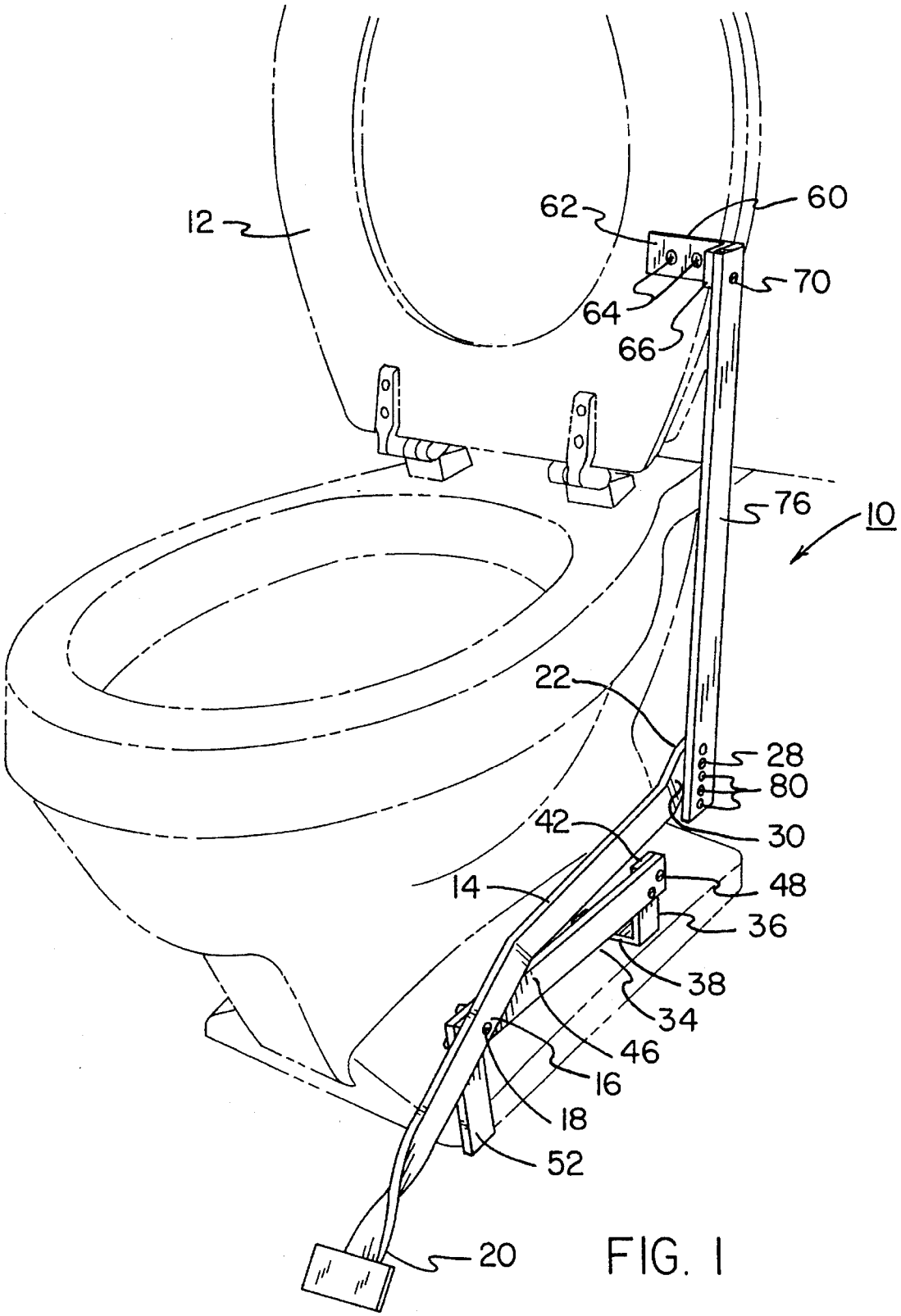
FIG. 1 is a perspective view of the preferred embodiment of the new and improved apparatus for the raising and self-lowering of a toilet seat constructed in accordance with the principles of the present invention.
Figure 2:
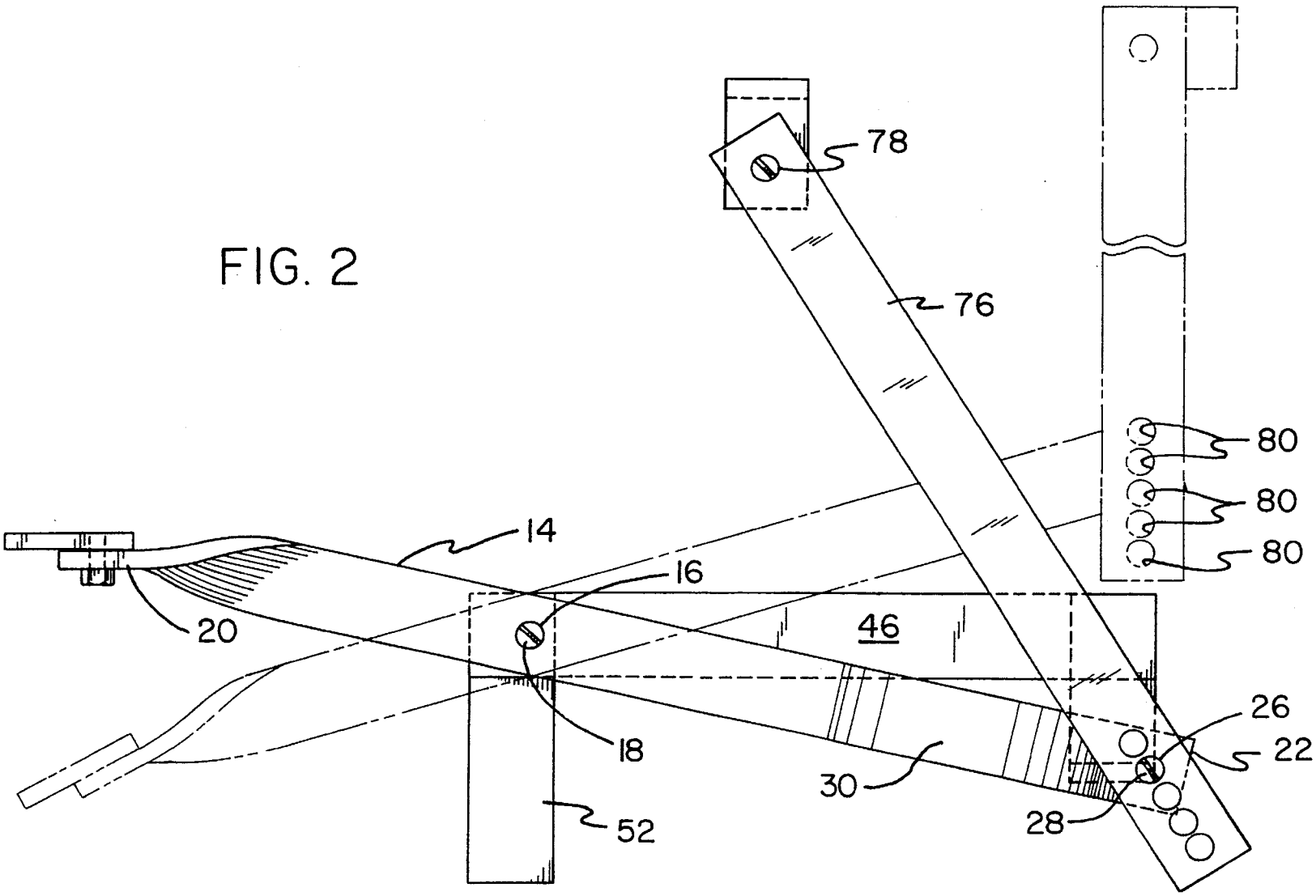
FIG. 2 is a side elevational view of the device illustrated in FIG. 1.
Figure 3:
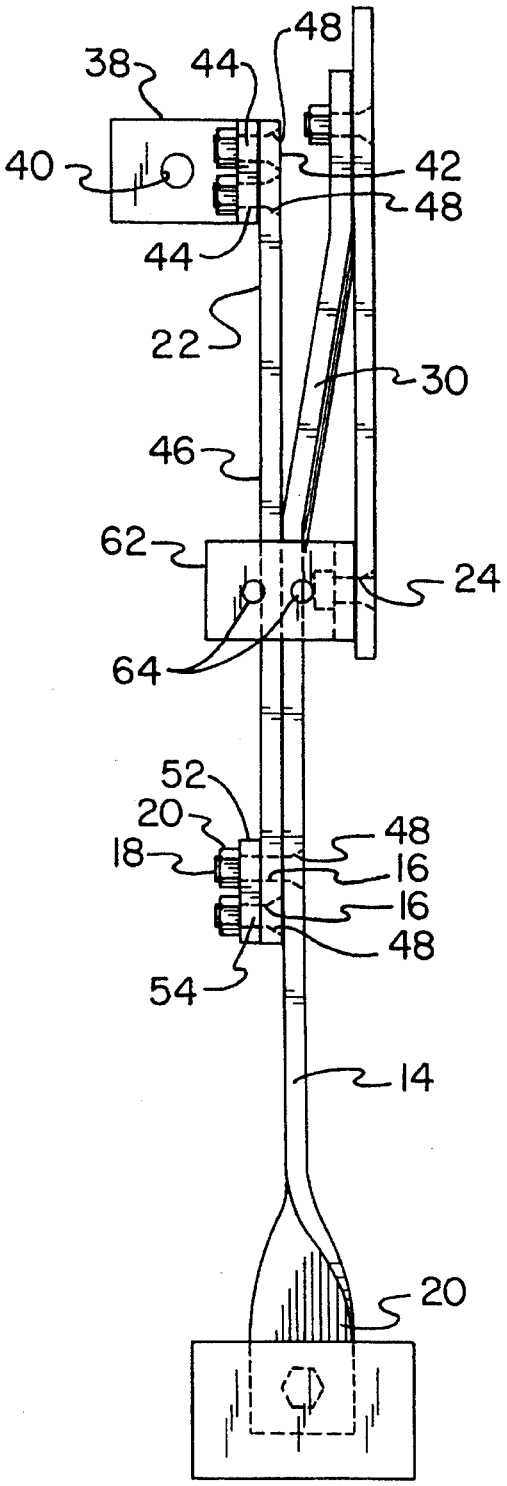
FIG. 3 is a top elevational view of the apparatus shown in FIGS. 1 and 2.
Figure 4:
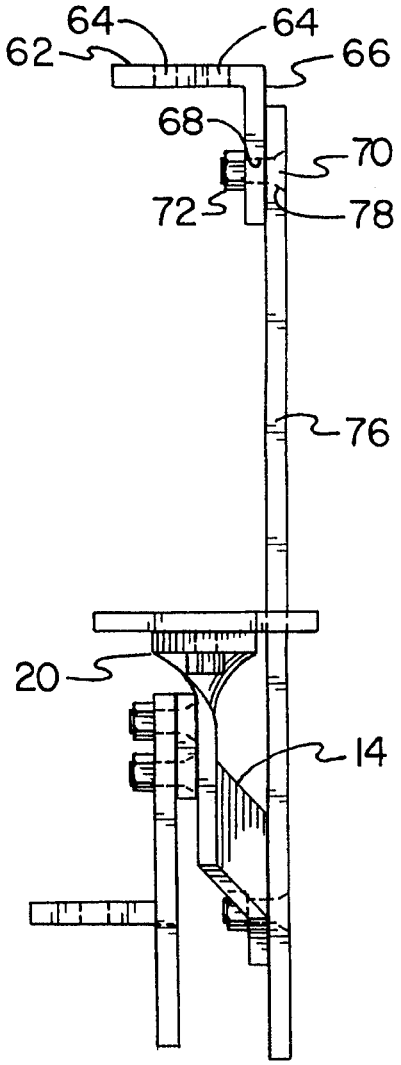
FIG. 4 is a front elevational view of the device illustrated in the prior Figures.
Figure 5:
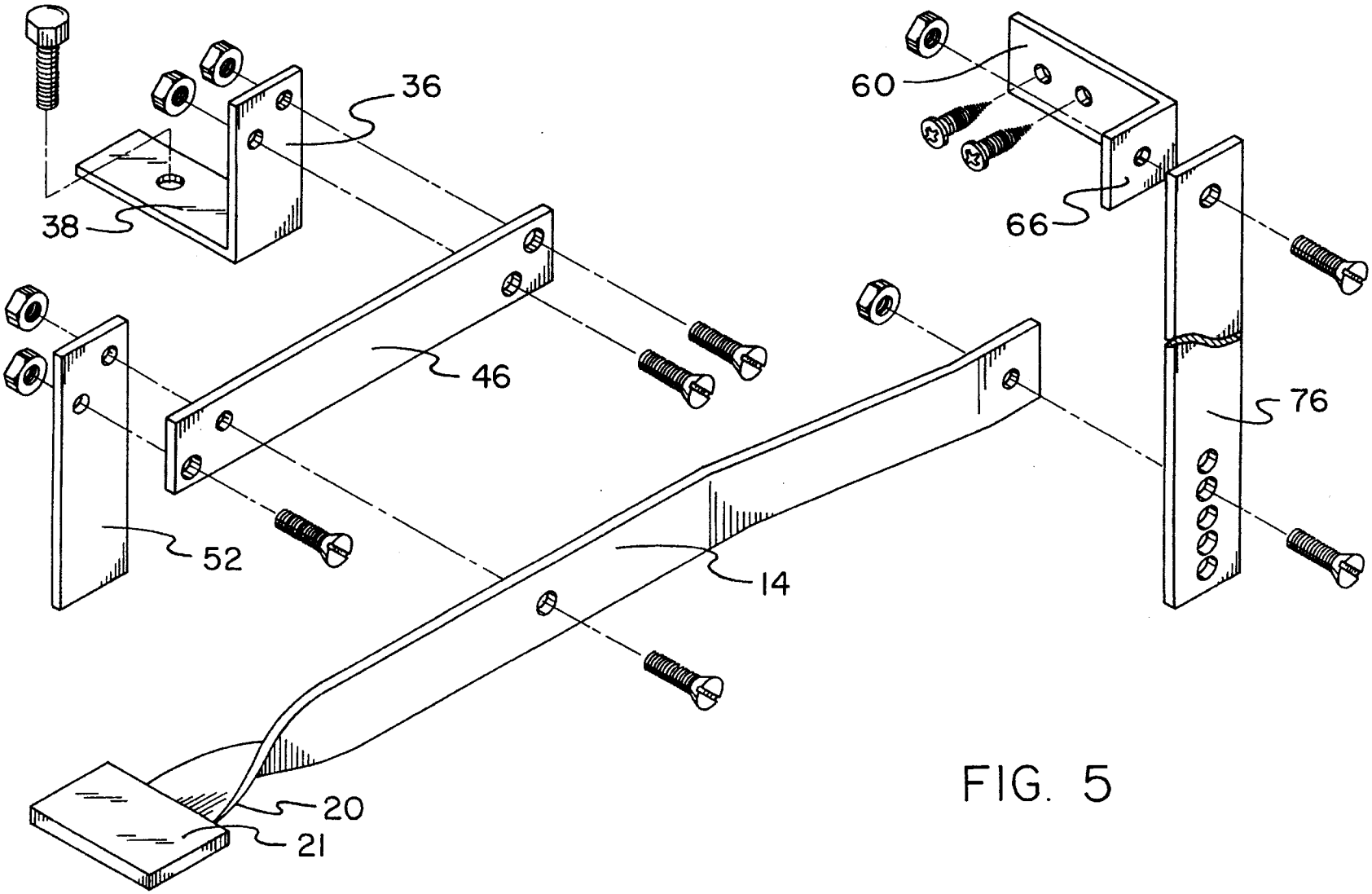
FIG. 5 is an exploded perspective view of the device of the prior Figures.

With reference now to the drawings, and in particular to FIG. 1 thereof, the preferred embodiment of the new and improved apparatus for the raising and self-lowering of a toilet seat embodying the principles and concepts of the present invention and generally designated by the reference numeral 10 will be described.

The present invention, the new and improved apparatus for the raising and self-lowering of a toilet seat, is comprised of a plurality of components. Such components, in their broadest context, include a lever, a support assembly and an attachment assembly. Such components are individually configured and correlated with respect to each other so as to attain the desired objective.

The central component of the system 10, a system designed for use in association with a toilet seat 12, is a lever 14. The lever is disposed in an essentially vertical plane although it may pivot with respect thereto. The lever has a central aperture 16 extending therethrough. Such is for the receipt of a bolt 18 adapted to be secured with an associated nut 19. The bolt is for constituting the pivot point for the lever.

The lever has an outboard end 20. Adjacent to the outboard end, the lever is formed with a twist 20 to about ninety degrees. A pedal 21 is formed therewith. The pedal is for being depressed by the foot of a user. The lever has an inboard end 22 with an aperture 24 extending therethrough. Such is for the receipt of a bolt 26 and associated nut 28. Such bolt is for transferring motion from the pedal to a toilet seat to be lifted upon the depression of the pedal. The lever is formed with an angular offset portion 30 between the central aperture and the inboard aperture. The regions of the pedal on opposite sides of the offset portion are parallel with respect to each other but in offsetting planes with respect to each other.

Next provided as a component of the system 10 is a support assembly 34. The support assembly is for attachment to the support bolt of the toilet bowl. It functions for supporting the lever at its pivot point. The support assembly includes an L-shaped bracket 36. Such bracket has a horizontal leg 38 formed with an aperture 40. Such is for being received by and secured to the support bolt of the toilet. The assembly also includes on the L-shaped bracket, an upstanding right leg 42. In such leg are a pair of apertures 44. The support assembly also has a horizontal bracket 46 with apertures 48 at the inboard and outboard ends thereof. Such apertures at the inboard end are coupled to the apertures of the L-shaped bracket.

The support assembly also includes a vertical bracket 52. The vertical bracket has an upper end with two apertures 54 adapted to be received in the outboard apertures of the horizontal bracket. It also includes a lower end 56 positionable in contact with the toilet for maintaining a proper orientation of the support assembly.

Lastly provided is the attachment assembly formed with an L-shaped bracket 60. Such bracket has an upper leg 62 with a pair of apertures 64. Such are adapted to be secured to the lower surface of the toilet seat. This is at a location adjacent to its outboard end on its undersurface. The L-shaped bracket also has a lower leg 66 positioned outboardly of the toilet seat. It has one aperture 68 therethrough. Such aperture is adapted to receive a bolt 70 with an associated nut 72. The attachment assembly also includes a vertical leg 76. Such leg has an upper end with one aperture 78 which extends therethrough. Such aperture is adapted to be coupled to the aperture of the L-shaped bracket. In addition, the vertical bracket also has a plurality of vertically-aligned apertures 80 extending therethrough. An associated bolt is positionable through a preselected one of the apertures for adjustment purposes. This is because such bolt 28 also extends through the aperture at the inboard end of the lever to effect the pivotable coupling therebetween.

The present invention comprises a foot pedal that attaches to a toilet seat and lid, enabling a man to lift the seat and lid without touching it, and then close it automatically, when he removes his foot. It includes a foot pedal attached to a hold-down bracket. One bolt secures the bracket into the floor. The hold-down bracket is connected to the underside of the toilet seat and is connected to the floor with a single bolt. The arm connects to a seat bracket which fits on the underside of the toilet seat. There are holes along the side of the arm for adjusting the balance point of the seat. The device may be made from aluminum, wood or plastic.

One simply places the foot pedal on the left or right side of the toilet and bolts it to the floor. Attach a hold-down bracket and bolt it to the floor, pulling it up alongside the toilet and up to the seat. Attach the seat bracket under the toilet seat and connect this to the hold-down bracket. Test by pressing on the foot pedal to see if it lifts the seat. Step off the foot pedal to see if the seat domes down automatically. Adjust the foot pedal in the adjustment holes as a way of changing the balance point at which the seat stays open or falls closed.

The present invention provides a way to ensure that men lower the toilet seat. It can also be used in public bathrooms and institutions as a way to avoid touching the seat and preventing the spread of germs and communicable diseases.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An apparatus for the raising and self-lowering of a toilet seat comprising:

a lever, the lever being disposed in an essentially vertical plane having a central aperture thereon and extending therethrough for the receipt of a bolt and an associated nut for constituting a pivot point, the lever having an outboard end with a pedal secured thereto for being depressed by the foot of a user, the lever having an inboard end with an aperture therethrough for receipt of a bolt with an associated nut for transferring motion from the pedal to a toilet seat to be lifted upon the depression of the pedal; and a support assembly for attachment to a support bolt of a toilet bowl and for supporting the lever at its pivot point, the support assembly including an L-shaped bracket with a horizontal leg formed with an aperture for being received by and secured to the support bolt of the toilet bowl and with the L-shaped bracket having an upstanding leg with an aperture, the support assembly also having a horizontal bracket having an inboard end and an outboard end with a pair of apertures at each end, one of the pair of apertures at the inboard end being coupled to the apertures of the L-shaped bracket, the support assembly also including a vertical bracket having an upper end with two apertures adapted to be received in the outboard apertures of the horizontal bracket and with a lower end positionable in contact with the toilet for maintaining a proper orientation of the support assembly.

2. The device as set forth in claim 1 and further including:

an attachment assembly having an L-shaped bracket with an upper leg having two apertures adapted to be secured to the lower surface of a toilet seat adjacent to an outboard end on its under surface with the L-shaped bracket having a lower leg positioned outboardly of the toilet seat with one aperture therethrough adapted to receive a bolt and an associated nut, the attachment assembly also including a vertical bracket having an upper end with one aperture extending therethrough adapted to be coupled to the one aperture of the L-shaped bracket, the vertical bracket having a plurality of vertically-aligned apertures therethrough with an associated bolt positionable through a preselected one of said apertures and the aperture at the inboard end of the lever for coupling therebetween.

3. A new and improved apparatus for the raising and self-lowering of a toilet seat comprising, in combination:

a lever, the lever being disposed in an essentially vertical plane having a central aperture thereon and extending therethrough for the receipt of a bolt and an associated nut for constituting a pivot point, the lever having an outboard end twisted ninety degrees with a pedal secured thereto for being depressed by the foot of a user, the lever having an inboard end with an aperture therethrough for receipt of a bolt with an associated nut for transferring motion from the pedal to a toilet seat to be lifted upon the depression of the pedal, the lever being formed with an angular offset portion between the central aperture and the inboard aperture with the pedal having regions on opposite sides thereof, the regions lying in parallel planes but offset with respect to each other;

a support assembly for attachment to a support bolt of a toilet bowl and for supporting the lever at its pivot point, the support assembly including an L-shaped bracket with a horizontal leg formed with an aperture for being received by and secured to the support bolt of the toilet bowl and with the L-shaped bracket having an upstanding leg with two apertures, the support assembly also having a horizontal bracket having an inboard end and an outboard end with apertures at the ends, the apertures at the inboard end of the horizontal bracket being coupled to the apertures of the L-shaped bracket, the support assembly also including a vertical bracket having an upper end with two apertures adapted to be received in the outboard apertures of the horizontal bracket and with a lower end positionable in contact with the toilet bowl for maintaining a proper orientation of the support assembly; and an attachment assembly having an L-shaped bracket with an upper leg having two apertures adapted to be secured to the lower surface of a toilet seat adjacent to its outboard end on its under surface with the L-shaped bracket having a lower leg positioned outboardly of the toilet seat with one aperture therethrough adapted to receive a bolt and an associated nut, the attachment assembly also including a vertical leg having an upper end with one aperture extending therethrough adapted to be coupled to the one aperture of the L-shaped bracket, the vertical bracket having a plurality of vertically-aligned apertures therethrough with an associated bolt positionable through a preselected one of said apertures and the aperture at the inboard end of the lever for coupling therebetween.

* * * * *